US005209346A

United States Patent [19]

Pratt et al.

[11] Patent Number: 5,209,346

[45] Date of Patent: May 11, 1993

[54] CARRIER STOCK WITH TEAR TABS

[75] Inventors: David A. Pratt, Waterville; J. Thomas Brinker, Perrysburg, both of Ohio

[73] Assignee: Owens-Illinois Plastic Products Inc., Toledo, Ohio

[21] Appl. No.: 852,058

[22] Filed: Mar. 16, 1992

[51] Int. Cl.[5] ..... B65D 75/62

[52] U.S. Cl. ..... 206/150; 206/151; 294/87.2

[58] Field of Search ..... 206/139, 145, 147, 149, 206/150, 151, 158, 161; 294/87.2

[56] References Cited

U.S. PATENT DOCUMENTS 4,925,020 5/1990 Gordon ..... 206/150
5,072,829 12/1991 Marco et al. ..... 206/150
5,115,910 5/1992 Klygis et al. ..... 206/150
5,139,137 8/1992 Marco ..... 206/150

*Primary Examiner*—Jimmy G. Foster

[57] ABSTRACT

A carrier and carrier stock comprising a plurality of severable interconnected carriers formed from a single sheet of resilient polymeric material such as low density polyethylene for machine application to substantially identical containers. Each carrier has container receiving apertures which are defined by band segments that include outer segments formed with tear tabs. Each tab has a pair of diverging slits extending from the sides thereof toward the outer segments, each slot terminating short of the outer segment. In this manner, the tab can be grasped either with a right hand or left hand and pulled to sever the outer segment releasing a container in the associated aperture.

6 Claims, 2 Drawing Sheets

CARRIER STOCK WITH TEAR TABS

This invention relates to carriers for containers and particularly to carriers for holding a plurality of containers such as cans.

BACKGROUND AND SUMMARY OF THE INVENTION

It has been common to provide carriers from carrier stock of resilient polymeric material such as low density polyethylene which include segments for defining apertures for receiving the containers. Such carriers are shown, for example, in U.S. Pat. Nos. 2,997,169, 3,504,790, and 3,721,337.

It has heretofore been suggested that tear tabs be associated with such containers to permit tearing of portions of the carrier to individually remove containers therefrom. Such carriers with tear tabs are shown, for example, in U.S. Pat. Nos. 4,064,989 and 5,020,661.

Among the objectives of the present invention are to provide carrier stock wherein tabs are provided that can be manipulated either by a right handed person or a left handed person; which carrier stock can be readily manufactured; and which provide for a firm application without inadvertently severing during the handling by automatic machinery; which thereafter can be readily severed without substantial force; and where inadvertent severing of the tab is obviated.

In accordance with the invention, the carrier stock is formed from a single sheet of resilient polymeric material such as low density polyethylene for machine application to substantially identical containers. The stock is severable to form individuals carriers with container receiving apertures which are defined by band segments that include outer segments formed with tear tabs. Each tab has a pair of diverging slits extending from the sides thereof toward the outer segments, each slit terminating short of the outer segment. In this manner, the tab can be grasped either with a right hand or left hand and pulled to severe the outer segment releasing a container in the associated aperture.

DESCRIPTION

Figure 1:
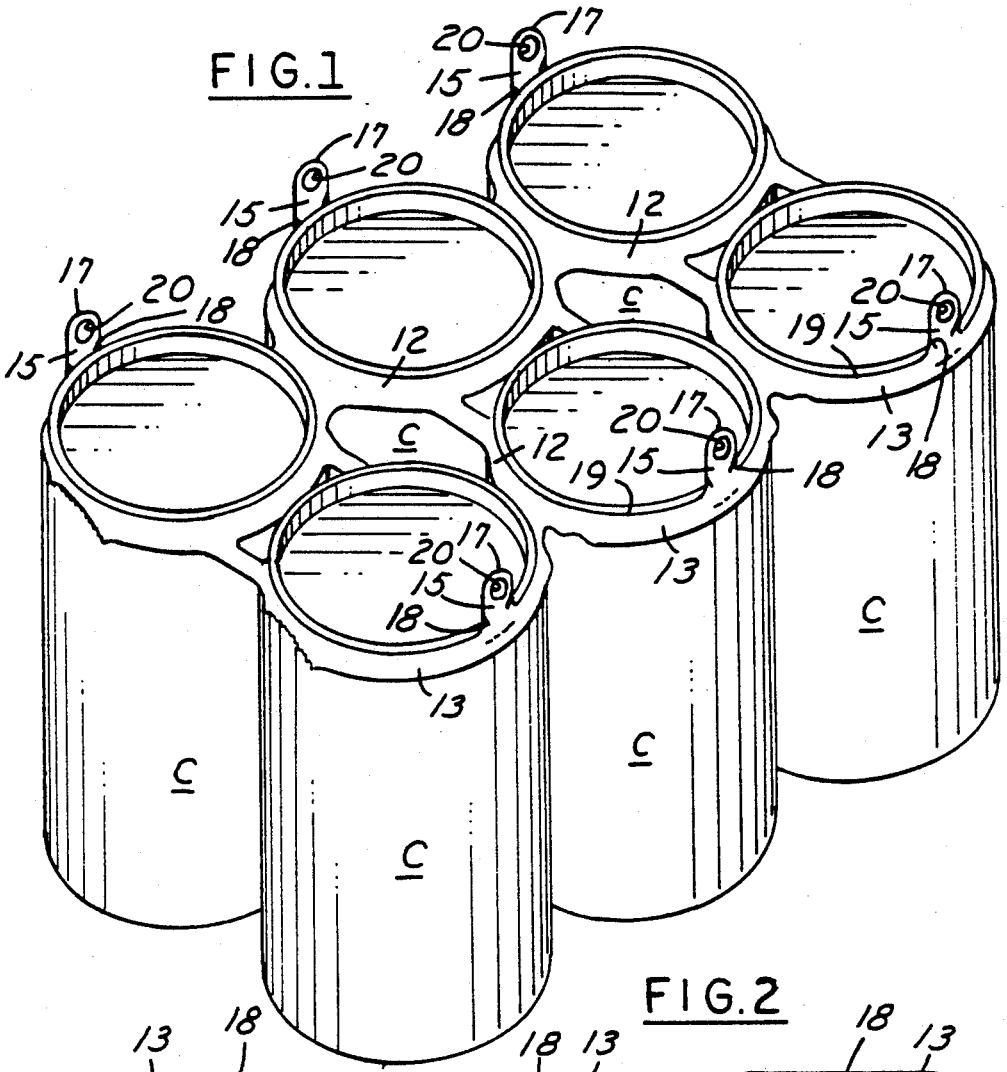
FIG. 1 is a perspective view of a package embodying the carrier of the present invention.
Figure 2:
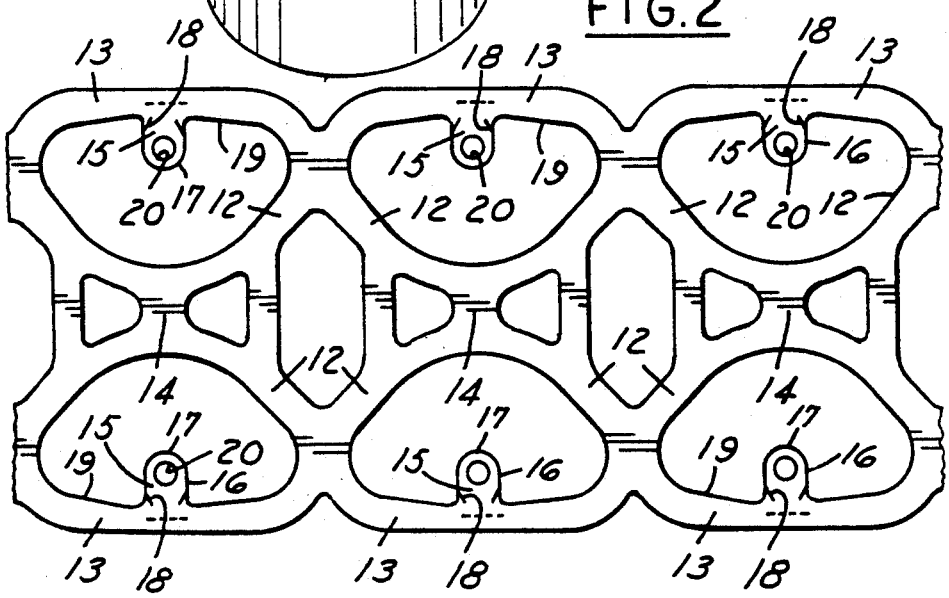
FIG. 2 is a plan view of a carrier embodying the invention.
Figure 3:
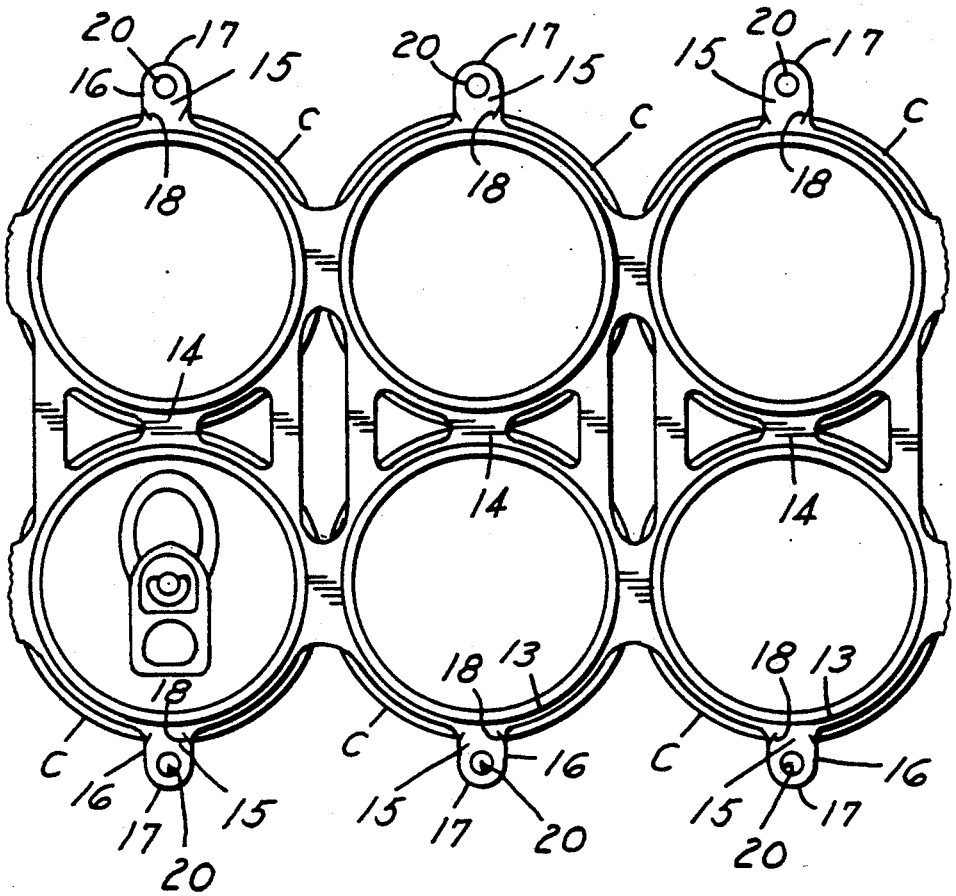
FIG. 3 is a plan view of the package shown in FIG. 1.

Referring to FIG. 1–4, carrier stock is shown which comprises a plurality of repetitive segments 10 which define openings or apertures 11 for receiving containers C. The openings or apertures 11 may be of various configurations such as shown in U.S. Pat. Nos. 4,018,331 and 4,219,117. Each aperture 11 is defined by inner segments 12 and an outer segment 13 and are interconnected by integral portions 14 to one another in a carrier stock strip.

Figure 4:
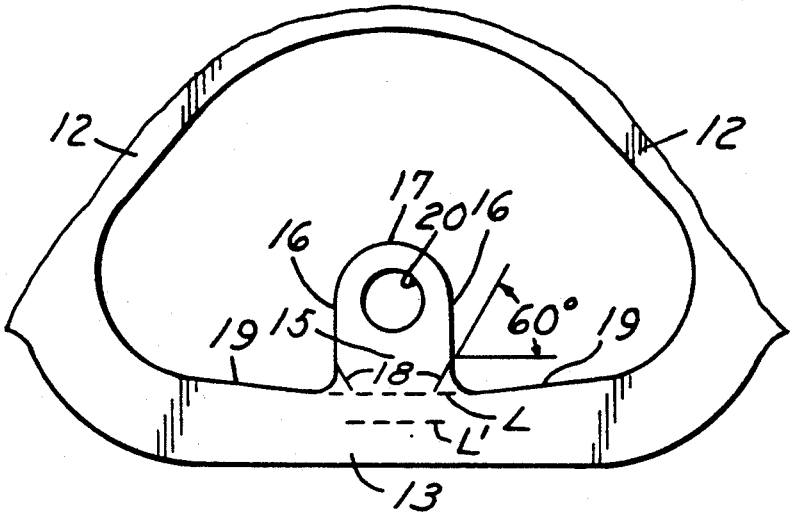
FIG. 4 is a fragmentary plan view of a portion of the carrier embodying the invention.

In accordance with the invention, a tab 15 extends radially inwardly from the outer segment 13 of each aperture 11 and has side edges 16 and an end edge 17 (FIG. 4). Each tab 15 includes a pair of slits 18 that extend from the peripheral edge of the side edge 16 toward the outer band segment 13 at an acute angle to the side edge but terminating short of the inner edge 19 of the segment such that the end of each slit does not extend past an imaginary line L drawn from the inner edges of the segment 13 across the tab 15. A weakened line L′ formed by a series of staggered and aligned slits extends along the outer segment 13 in the area of the tab 15 and is spaced a distance from line L such that a line extending through each slit 18 intersects the line L′.

The carrier with the tabs 15 can be applied to containers such as cans C utilizing well known automated machinery. When a container C is to be removed, a tab 15 is grasped either with the right hand or left hand and pulled, such that a slit 18 directs the tear force through the outer segment to permit the container to be removed without any additional force.

It has been found that the angle which the slit 18 makes with the peripheral edge of the outer segment is greater than 45° and preferably about 60° in order that the tear force will be directed toward the outer segments. The distance between line L and line L′ is preferably less than the distance between the inner ends of opposed slits 18.

The tabs 15 preferably include an opening 20 adjacent the free ends thereof to facilitate grasping the container.

We claim:

1. A carrier formed from a single sheet of resilient polymeric material such as low density polyethylene for machine application to substantially identical containers, said carrier having container receiving apertures which are defines by band segments that include outer segments, a tear tab extending radially inwardly from each outer segment, each tab having a pair of diverging slits extending from a side edge thereof toward the respective adjacent outer segment, the slits terminating short of the outer segments, such that the tab can be grasped either with a right hand or left hand and pulled to severe the outer segment releasing the container in the associated aperture, and a weakened line extending longitudinally along each outer segment, such that a line drawn through each slit intersects the weakened line.

2. The carrier set forth in claim 1 wherein the angle which each slit makes with an inner edge of the respective adjacent segment is at least 45°.

3. The carrier set forth in claim 1 wherein the angle which each slit makes with an inner edge of the associated outer segment is about 60°.

4. The carrier set forth in claim 1 wherein each tab has an opening therethrough to facilitate grasping the container.

5. The carrier set forth in claim 1 wherein said weakened line comprises a series of spaced and aligned sets.

6. Carrier stock comprising a plurality of interconnected severable carriers constructed in accordance with any one of claims 1–5.

* * * * *

UNITED STATES PATENT AND TRADEMARK OFFICE

CERTIFICATE OF CORRECTION

PATENT NO. : 5,209,346

DATED : May 11, 1993

INVENTOR(S) : David A. Pratt and J. Thomas Brinker

It is certified that error appears in the above-identified patent and that said Letters Patent is hereby corrected as shown below:

Column 2, line 30, "container" should be --carrier--

Column 2, line 59, "container" should be --carrier--

Signed and Sealed this

Twenty-second Day of March, 1994

*Attest:*

Bruce Lehman

BRUCE LEHMAN

*Attesting Officer*

*Commissioner of Patents and Trademarks*